US009322384B2

(12) United States Patent
Hujishiro et al.

(10) Patent No.: US 9,322,384 B2
(45) Date of Patent: Apr. 26, 2016

(54) GLOW PLUG CONTROL DRIVE METHOD AND GLOW PLUG DRIVE CONTROL SYSTEM

(75) Inventors: Yoshito Hujishiro, Saitama (JP); Yutaka Tanaka, Saitama (JP); Tomohiro Nakamura, Saitama (JP)

(73) Assignee: Bosch Corporation, Tokyo (JP)

( * ) Notice: Subject to any disclaimer, the term of this patent is extended or adjusted under 35 U.S.C. 154(b) by 225 days.

(21) Appl. No.: 13/993,165

(22) PCT Filed: Dec. 6, 2011

(86) PCT No.: PCT/JP2011/078158

§ 371 (c)(1),
(2), (4) Date: Jun. 11, 2013

(87) PCT Pub. No.: WO2012/081448

PCT Pub. Date: Jun. 21, 2012

(65) Prior Publication Data

US 2013/0255615 A1 Oct. 3, 2013

(30) Foreign Application Priority Data

Dec. 16, 2010 (JP) ..... 2010-280376

(51) Int. Cl.
*F02P 23/00* (2006.01)
*F02P 19/02* (2006.01)
(Continued)

(52) U.S. Cl.
CPC ..... *F02P 23/00* (2013.01); *F02P 19/02* (2013.01); *F02P 19/022* (2013.01); *F02P 19/026* (2013.01); *F02D 2041/2027* (2013.01); *F02P 19/023* (2013.01); *F23Q 7/001* (2013.01)

(58) Field of Classification Search
CPC ..... F02P 23/00; F02P 19/02; F02P 19/021; F02P 19/022; F02P 19/023; F02P 19/025; F02P 19/026; F02P 19/027; F02P 19/028; F23Q 7/001
USPC ..... 123/145 A, 179.6
See application file for complete search history.

(56) References Cited

U.S. PATENT DOCUMENTS 4,177,785 A * 12/1979 Sundeen ..... F02P 19/022 123/145 A
4,307,689 A * 12/1981 Raeske ..... F02P 19/022 123/145 A (Continued)

FOREIGN PATENT DOCUMENTS

| | | |
|---|---|---|
| JP | H03117685 | 5/1991 |
| JP | H1077946 | 3/1998 |
| JP | 2009013983 | 1/2009 |

OTHER PUBLICATIONS

International Search Report for Application No. PCT/JP2011/078158 dated Mar. 13, 2012 (1 page).

*Primary Examiner* — Stephen K Cronin
*Assistant Examiner* — Kevin R Steckbauer
(74) *Attorney, Agent, or Firm* — Michael Best & Friedrich LLP

(57) ABSTRACT

To suppress current fluctuations upon commencement of driving and prolong lifespan by reducing electric stress caused by current fluctuations.

A glow plug 1, a glow switch 2, and a stabilizing coil 3 are series-connected, and upon commencement of the driving of the glow plug 1, a repetition frequency of PWM signals that control the opening and closing of the glow switch 2 is made into a higher frequency than a repetition frequency in a normal drive state and the opening and closing of the glow switch 2 is controlled (S104), and when a predetermined drive shift condition has been met (S106), the repetition frequency of the PWM signals is returned to the frequency during normal driving and the opening and closing of the glow switch 2 is controlled (S108), whereby the current upon commencement of driving is smoothed and the occurrence of an instantaneous large current is suppressed.

8 Claims, 3 Drawing Sheets

(51) Int. Cl.
*F23Q 7/00* (2006.01)
*F02D 41/20* (2006.01)

(56) References Cited

U.S. PATENT DOCUMENTS 4,391,237 A * 7/1983 Abe ..... F02P 19/022 123/145 A
4,413,174 A * 11/1983 Ting ..... F02P 19/022 123/179.21
4,669,430 A * 6/1987 Reinold ..... F02P 19/021 123/145 A
4,701,596 A * 10/1987 Schirmer ..... B60Q 11/00 123/179.21
5,050,545 A * 9/1991 Shirata ..... F02P 19/02 123/145 A
5,327,870 A * 7/1994 Boisvert ..... F02P 19/02 123/145 A
5,698,974 A * 12/1997 Van Dyke ..... G01F 23/0061 324/144
6,009,369 A * 12/1999 Boisvert ..... F02P 19/026 123/145 A
7,487,753 B2 * 2/2009 Gotou ..... F02P 19/021 123/145 A
7,899,609 B2 * 3/2011 Rodrigues ..... F02D 35/025 123/145 A
8,269,145 B2 * 9/2012 Blanc ..... F02P 19/022 123/145 A

* cited by examiner

GLOW PLUG CONTROL DRIVE METHOD AND GLOW PLUG DRIVE CONTROL SYSTEM

BACKGROUND OF THE INVENTION

The present invention pertains to a method and system for controlling the driving of a glow plug used mainly to aid the starting of diesel engines, and particularly relates to a method and system in which current fluctuations are reduced.

As a method of energizing a glow plug used to aid the starting of vehicular diesel engines, it is common to use pulse width modulation (PWM), which has advantages including little electric loss during voltage control and being able to set a flexible voltage on the basis of the effective voltage, and various drive control methods based on pulse width modulation have been proposed and put into practical use (e.g., see JP A 2009 13983).

However, in a case where drive control based on the effective voltage is applied to a glow plug, current fluctuations also occur in accompaniment with voltage fluctuations, but because glow plugs consume a lot of power, the current fluctuations accompanying the voltage fluctuations are also large, there are also cases where current fluctuations reach more than 10 amperes at peak times, and there is the problem that this imparts electric stress resulting from current fluctuations in the heater section, quickens the deterioration of the glow plug, and leads to a shortened lifespan.

SUMMARY OF THE INVENTION

The present invention provides a glow plug drive control method and system that can suppress current fluctuations upon commencement of driving and prolong lifespan by reducing electric stress caused by current fluctuations.

According to a first aspect of the present invention, there is provided a method of controlling the driving of a glow plug in a glow plug drive control system in which a glow switch, a stabilizing coil, and a glow plug are series-connected, a battery voltage is applied to one end of the glow switch, another end of the glow plug is disposed connected to a ground, an electronic control unit that controls the opening and closing of the glow switch is disposed, and which enables driving to energize the glow plug, wherein upon commencement of the driving of the glow plug, the method makes a repetition frequency of PWM signals that control the opening and closing of the glow switch a higher frequency than a repetition frequency in a normal drive state and performs opening and closing of the glow switch, and when a predetermined drive shift condition has been met, the method returns the repetition frequency of the PWM signals to the frequency during normal driving.

Further, according to a second aspect of the present invention, there is provided a glow plug drive control system in which a glow switch, a stabilizing coil, and a glow plug are series-connected, a battery voltage is applied to one end of the glow switch, another end of the glow plug is disposed connected to a ground, an electronic control unit that controls the opening and closing of the glow switch is disposed, and which enables driving to energize the glow plug, wherein the electronic control unit is configured in such a way that, upon commencement of the driving of the glow plug, it can make a repetition frequency of PWM signals that control the opening and closing of the glow switch a higher frequency than a repetition frequency in a normal drive state and control the opening and closing of the glow switch and, when it has been determined that a predetermined drive shift condition has been met, it can return the repetition frequency of the PWM signals to the frequency during normal driving and control the opening and closing of the glow switch.

DETAILED DESCRIPTION

Figure 1:
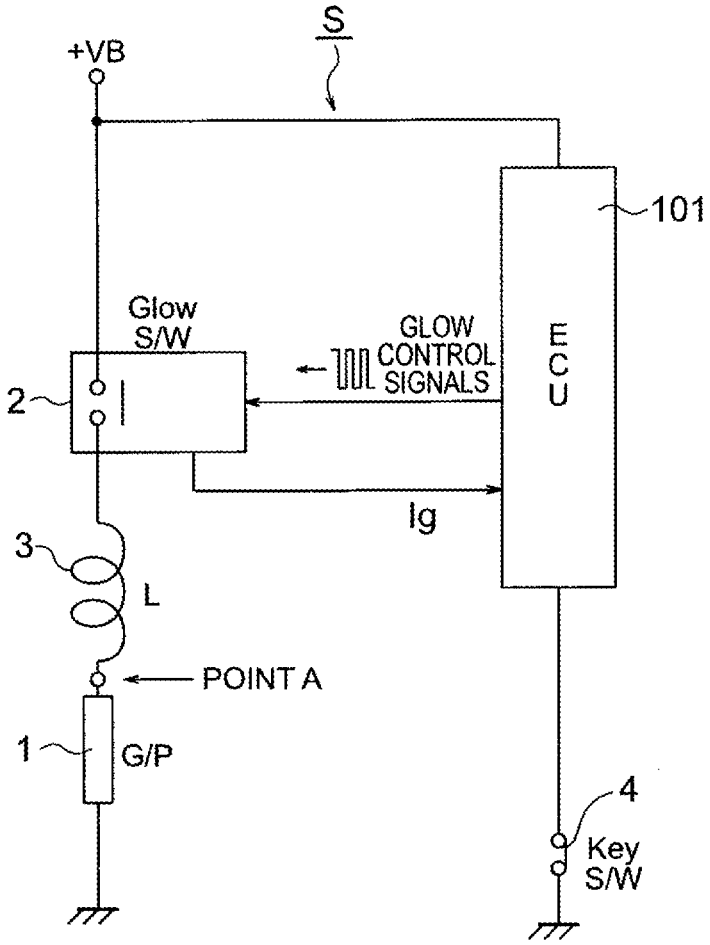
FIG. 1 is a configuration diagram showing an example configuration of a glow plug drive control system in an embodiment of the present invention.

An embodiment of the invention will be described below with reference to FIG. 1 to FIG. 3.

It will be noted that the members and arrangements described below are not intended to limit the present invention and can be variously modified within the scope of the gist of the present invention.

First, the configuration of a glow plug drive control system in the embodiment of the present invention shown in FIG. 1 will be described.

A glow plug drive control system S in the embodiment of the present invention is configured taking as its main configural elements an electronic control unit (abbreviated as "ECU" in FIG. 1) 101, a glow switch 2, and a stabilizing coil 3.

The electronic control unit 101 is, for example, mainly configured by a microcomputer (not shown in the drawings) having a publicly-known/well-known configuration, has storage elements (not shown in the drawings) such as a RAM and a ROM, and has an input/output interface circuit (not shown in the drawings) for transferring signals to and receiving signals from external circuits; the electronic control unit 101 executes engine control and fuel injection control in a vehicle and later-described glow plug drive control processing. The electronic control unit 101 generates and outputs PWM (Pulse Width Modulation) signals as control signals for switching a glow plug 1 on and off.

The glow switch 2 is operated on and off by the control signals (PWM signals) output from the electronic control unit 101; more specifically, the glow switch 2 is configured taking as its main configural element a semiconductor device such as a field-effect transistor, for example.

The glow switch 2 in the embodiment of the present invention is configured by a field-effect transistor (not shown in the drawings) serving as a semiconductor device for switching that is disposed in series between an unillustrated vehicular battery and the glow plug 1 as described later, a circuit for switching the field-effect transistor on and off with the control signals (PWM signals) output from the electronic control unit 101, and a circuit for detecting an energizing current Ig flowing to the glow plug 1 via the field-effect transistor (not shown in the drawings), and the circuit configuration of the glow switch 2 is basically the same as a conventional circuit configuration. The detection signal of the energizing current Ig is input to the electronic control unit 101 and is supplied for calculating cumulative energy described later.

In the glow switch 2, one terminal that is opened and closed (e.g., the drain of the field-effect transistor) is connected to the unillustrated vehicular battery and a battery voltage VB is applied thereto, and the other terminal that is opened and closed (e.g., the source of the field-effect transistor) is connected to one end of the stabilizing coil 3.

Additionally, the glow plug 1 is disposed between the other end of the stabilizing coil 3 and a ground.

The electronic control unit 101 has a configuration where the electronic control unit 101 and an ignition switch (in FIG. 1, abbreviated as "Key SW") 4 are series-connected in this order from the vehicular battery side and disposed between the unillustrated vehicular battery and the ground; by switching the ignition switch 4 on (a closed state), the battery voltage VB is applied to the electronic control unit 101.

Next, the glow plug drive control processing executed by the electronic control unit 101 in this configuration will be described with reference to the sub-routine flowchart shown in FIG. 2.

Figure 2:
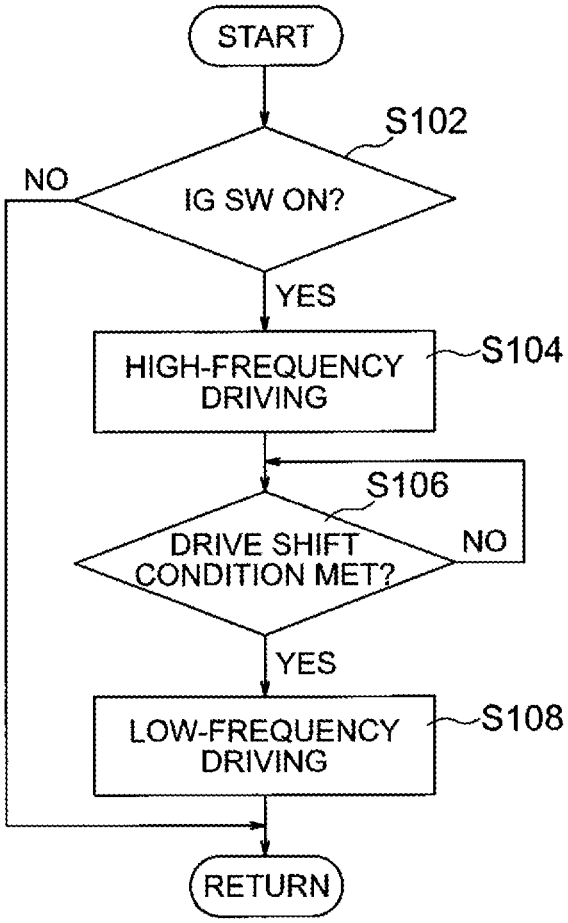
FIG. 2 is a sub-routine flowchart showing a sequence of glow plug drive control processing executed by an electronic control unit configuring the glow plug drive control system shown in FIG. 1.

When the processing is commenced by the electronic control unit 101, first, it is determined whether or not the ignition switch 4 is on (see step S102 in FIG. 2).

In a case where it has been determined in step S102 that the ignition switch 4 is on (in the case of YES), the electronic control unit 101 judges that driving of the glow plug 1 is to be commenced and advances to the processing of step S104 described next, and in a case where it has been determined that the ignition switch 4 is not on (in the case of NO), the electronic control unit 101 judges that it is not necessary to drive the glow plug 1, ends the processing, and temporarily returns to an unillustrated main routine.

In step S104, a repetition frequency of the control signals (PWM signals) applied from the electronic control unit 101 to the glow switch 2 is set to a higher frequency than during normal driving and is output, whereby the glow switch 2 starts to be driven by high-frequency driving. As for how high of a frequency the repetition frequency is be set to, it is suitable to specifically set suitable values on the basis of tests and simulation results in consideration of differences in drive currents resulting from differences in the types of glow plugs in individual vehicles.

Next, the electronic control unit 101 advances to the processing of step S106 where it is determined whether or not a drive shift condition has been met.

That is, in the embodiment of the present invention, the electronic control unit 101 performs the high-frequency driving with respect to the glow plug 1 only for a predetermined period at the initial stage of the driving of the glow plug 1, and thereafter the electronic control unit 101 performs low-frequency driving resulting from the normal repetition frequency (see step S108 in FIG. 2); in step S106, it is determined whether or not a predetermined condition for shifting from the high-frequency driving to the low-frequency driving has been met.

Specific examples of the drive shift condition include a predetermined amount of elapsed time since the commencement of driving. That is, the electronic control unit 101 determines whether or not a predetermined amount of time has elapsed since the commencement of driving, and in a case where it has been determined that the predetermined amount of time has elapsed, the electronic control unit 101 judges to shift to the low-frequency driving.

In this case, it is suitable for the electronic control unit 101 to be configured to change the predetermined amount of elapsed time depending on the drive state of the engine (not shown in the drawings), for example.

More specifically, for example, the engine cooling water temperature may be used as a parameter representing the drive state of the engine, the relationship between various engine cooling water temperatures and suitable predetermined amounts of elapsed time with respect to each of the engine cooling water temperatures obtained on the basis of tests and simulation results is turned into a map so as to be stored in an appropriate storage region in the electronic control unit 101. Then, the electronic control unit 101 may read out, from the map, the predetermined amount of elapsed time corresponding to the engine cooling water temperature at the time of execution of step S106 and use the appropriate predetermined amount of elapsed time to determine whether or not it is necessary to shift the driving.

The drive shift condition is not limited to this, and selecting suitable drive shift conditions depending on various specific conditions of the vehicle is preferred.

As another example of the drive shift condition, the electronic control unit 101 may also be configured to use the cumulative energy of the glow plug 1, which is the amount of energy that has been expended for driving the glow plug 1 since the commencement of the driving, and determine whether or not the drive shift condition has been met by determining whether or not the cumulative energy has exceeded a predetermined value.

That is, various expressions can be adopted for the cumulative energy of the glow plug 1; as one example, when Vg represents the voltage applied to the glow plug 1 and t represents the amount of elapsed time since the commencement of driving, the cumulative energy Eg can be expressed as $Eg=Vg^2\times t$. Here, Vg is an effective value (RMS).

Further, when Vg represents the voltage applied to the glow plug 1 and Ig represents the energizing current of the glow plug 1, the cumulative energy can also be expressed as an integrated value thereof. Here, the energizing current Ig is detected in the glow switch 2 as stated earlier and is input to the electronic control unit 101.

That is, the cumulative energy Eg in this case becomes $Eg=\int Vg(t)\times Ig(t)dt$. The integrated time (integrated period) is the amount of time from the commencement of the driving of the glow plug 1 to the judgment of the drive shift condition.

As for the predetermined value for judging whether or not the cumulative energy has exceeded the value with which the drive shift condition can be determined as having been met, it is suitable to specifically set suitable values on the basis of tests and simulation results in accordance with differences in various conditions of individual vehicles.

Further, in the embodiment of the present invention, the energizing current Ig is configured to be detected in the glow switch 2, but it is not necessary for the method of detecting the energizing current Ig to be limited to directly detecting the energizing current Ig, and the energizing current Ig may also be obtained by series-connecting and disposing a resistor for detection on the line through which the energizing current Ig flows, inputting the voltage drop in the resistor to the electronic control unit 101, and converting the voltage drop to a current.

Then, when it is determined in step S106 that the drive shift condition has been met (in the case of YES), the electronic control unit 101 advances to the processing of step S108 where the glow plug 1 becomes driven at a low frequency. That is, the glow switch 2 becomes driven on and off by the PWM signals with the normal repetition frequency from the electronic control unit 101, and the electronic control unit 101 temporarily returns to the unillustrated main routine.

Figure 3A:
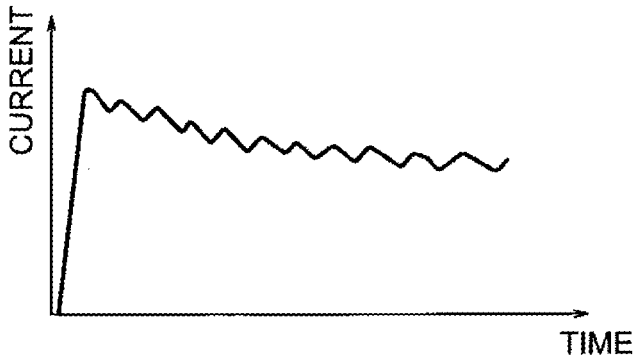
FIG. 3(A) and FIG. 3(B) are waveform diagrams showing current changes when driving the glow plug with the glow plug drive control system shown in FIG. 1, with FIG. 3(A) being a waveform diagram showing current changes in the glow plug during high-frequency driving and FIG. 3(B) being a waveform diagram showing current changes in the glow plug during low-frequency driving.

In this way, upon commencement of the driving of the glow plug 1, the electronic control unit 101 drives the glow plug 1 at a high frequency, so as for the current flowing through the glow plug 1, in contrast to convention, there is not a situation where a large current flows instantaneously upon commencement of the driving and thereafter the current value falls and returns to a steady state, and due to the synergistic effect of the high-frequency driving and the stabilizing coil 3, as schematically shown in FIG. 3(A), a current in a substantially smoothed state flows. For that reason, in contrast to convention, electric stress with respect to the glow plug 1 resulting from an instantaneous large current at the time of the commencement of driving becomes extremely low.

Figure 3B:
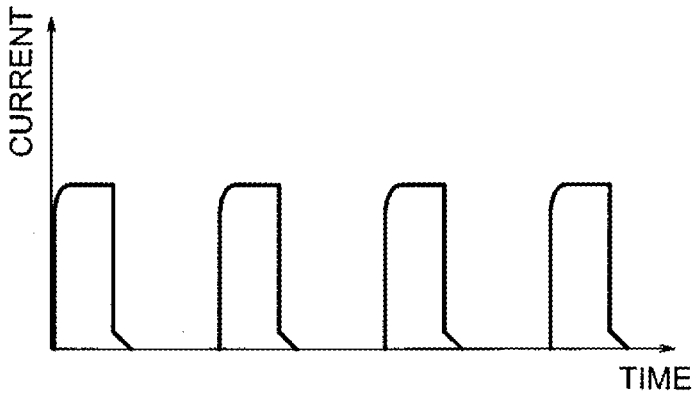

Additionally, when the electronic control unit 101 has shifted to the low-frequency driving, the repetition period of the PWM signals is low, so the current waveform is not continuous as shown in FIG. 3(A) but becomes a current waveform substantially similar to that of the PWM signals as shown schematically in FIG. 3(B).

In FIG. 3(A) and FIG. 3(B), the horizontal axis represents elapsed time since the commencement of the driving of the glow plug 1 and the vertical axis represents the current flowing through the glow plug 1. Further, the current waveforms in FIG. 3(A) and FIG. 3(B) are current waveforms at point A shown in FIG. 1.

According to the present invention, the series insertion of the stabilizing coil into the energizing path of the glow plug and the increase of the repetition frequency of the PWM signals for controlling the energizing of the glow plug upon the commencement of the driving of the glow plug combine so that the current flowing to the glow plug upon the commencement of driving is smoothed, and in contrast to convention, a large current is prevented from instantaneously flowing upon the commencement of driving, so the present invention achieves the effects of not only reliably reducing electric stress with respect to the glow plug to thereby enable a prolongation of lifespan but also reducing power loss to thereby contribute to saving the power of the system.

Further, the occurrence of an instantaneous large current upon the commencement of the driving of the glow plug is suppressed, so the occurrence of noise is suppressed, adverse effects such as circuit malfunction caused by the occurrence of noise can be reduced and suppressed, and a system with higher reliability can be provided.

The present invention is configured to be able to suppress the occurrence of a large current upon commencement of driving, so the present invention is suited for a glow plug drive control system in vehicles and so forth in which the reduction of electric stress caused by a large current is desired.

What is claimed is:

1. A method of controlling the driving of a glow plug in a glow plug drive control system which enables driving to energize the glow plug, the system comprising: a glow switch, a stabilizing coil, and a glow plug that are series-connected, a battery voltage being applied to one end of the glow switch, another end of the glow plug connected to a ground; and an electronic control unit that controls the opening and closing of the glow switch, the method comprising:

in an initial drive state, performing opening and closing of the glow switch, with a first frequency of PWM signals, the initial drive state occurring on commencement of driving the glow plug; and in a normal drive state, performing opening and closing of the glow switch with a second frequency of PWM signals, the normal drive state occurring when a predetermined drive shift condition has been met;

wherein the first frequency is higher than the second frequency; and wherein the predetermined drive shift condition is the cumulative energy that has been expended for driving the glow plug since the commencement of the driving of the glow plug, and it is determined that the predetermined drive shift condition has been met when it has been determined that the cumulative energy has reached a predetermined value.

2. The glow plug drive control method according to claim 1, wherein the predetermined drive shift condition is the amount of elapsed time since the commencement of driving, and it is determined that the predetermined drive shift condition has been met when the amount of elapsed time has reached a predetermined amount of elapsed time.

3. The glow plug drive control method according to claim 1, wherein when Vg represents the voltage applied to the glow plug and t represents the amount of elapsed time since the commencement of driving, the cumulative energy is expressed as $Vg^2 \times t$.

4. The glow plug drive control method according to claim 1, wherein when Vg represents the voltage applied to the glow plug and Ig represents the energizing current of the glow plug, the cumulative energy is expressed as $\int Vg(t) \times Ig(t)dt$.

5. A glow plug drive control system which enables driving to energize a glow plug, the system comprising:

a glow switch, a stabilizing coil, and a glow plug that are series-connected, a battery voltage being applied to one end of the glow switch, another end of the glow plug being connected to a ground; and an electronic control unit that controls the opening and closing of the glow switch, wherein the electronic control unit is configured to perform opening and closing of the glow switch in an initial drive state with a first frequency of PWM signals, the initial drive state occurring on commencement of driving the glow plug; and perform opening and closing of the glow switch in a normal drive state with a second frequency of PWM signals, the normal drive state occurring when a predetermined drive shift condition has been met;

wherein the first frequency is higher than the second frequency; and wherein the predetermined drive shift condition is the cumulative energy that has been expended for driving the glow plug since the commencement of the driving of the glow plug, and it is determined that the predetermined drive shift condition has been met when it has been determined that the cumulative energy has reached a predetermined value.

6. The glow plug drive control system according to claim 5, wherein the predetermined drive shift condition is the amount of elapsed time since the commencement of driving, and the electronic control unit is configured to judge that the predetermined drive shift condition has been met when it has been determined that the amount of elapsed time has reached a predetermined amount of elapsed time.

7. The glow plug drive control system according to claim 5, wherein when Vg represents the voltage applied to the glow plug and t represents the amount of elapsed time since the commencement of driving, the cumulative energy is expressed as $Vg^2 \times t$.

8. The glow plug drive control system according to claim 5, wherein when Vg represents the voltage applied to the glow plug and Ig represents the energizing current of the glow plug, the cumulative energy is expressed as $\int Vg(t) \times Ig(t)dt$.

* * * * *